United States Patent [19]

Riley

[11] 4,040,154

[45] Aug. 9, 1977

[54] JET TEXTURING PROCESS AND APPARATUS

[75] Inventor: Myrne Rodney Riley, Fayetteville, N.C.

[73] Assignee: Rohm and Haas Company, Philadelphia, Pa.

[21] Appl. No.: 627,307

[22] Filed: Oct. 30, 1975

Related U.S. Application Data

[63] Continuation-in-part of Ser. No. 533,600, Dec. 17, 1974, abandoned.

[51] Int. Cl.[2] ..... D02G 1/16

[52] U.S. Cl. ..... 28/273

[58] Field of Search ..... 28/1.4, 72.12, 271, 28/273; 57/34 B, 157 F; 226/7, 97; 302/25, 63; 239/601

[56] References Cited

U.S. PATENT DOCUMENTS

| | | | |
|---|---|---|---|
| 2,664,010 | 12/1953 | Emerson | 28/1.4 X |
| 3,110,950 | 11/1963 | Yamamoto | 28/1.4 |
| 3,302,237 | 2/1967 | Cope et al. | 28/1.4 X |
| 3,402,446 | 9/1968 | Benson | 28/1.4 |

*Primary Examiner*—Louis K. Rimrodt
*Attorney, Agent, or Firm*—Patrick C. Baker

[57] ABSTRACT

Thermoplastic yarn is textured while at a temperature at or above its plasticizing temperature by impingement thereon of a converging stream of compressible fluid. Prior to impingement, the fluid stream is passed through a convergent/divergent flow path to accelerate the impinging fluid to a velocity in excess of Mach 1. The yarn is under tension at the point of fluid impingement. Subsequently the yarn is cooled below its plasticizing temperature while in a substantially tensionless condition. Apparatus for performing the texturing process is disclosed.

14 Claims, 11 Drawing Figures

JET TEXTURING PROCESS AND APPARATUS

This application is a continuation-in-part of application Ser. No. 533,600 filed Dec. 17, 1974 and now abandoned.

BACKGROUND OF THE INVENTION

This invention relates to a process and apparatus for texturing thermoplastic yarn and to yarn made thereby.

Many procedures are available for the treatment of thermoplastic mono- or multi-filament yarns to "texture" them, that is, to crimp the yarn, thereby rendering them more voluminous or bulky. While entangling of multi-filament yarns also contributes to bulk, entangling normally is a separate operation from crimping and is not considered to be "texturing". Texturing procedures include a number of processes in which the yarn is subjected to treatment by a stream of fluid such as air or steam. It is also well recoginized that permanent texture and bulk requires that the treatment be carried on at temperatures above the plasticizing temperature of the yarn. The texturing is non-permanent, if, when the yarn is pulled slightly and released, the deformations are substantially removed so that the filaments appear to be generally straight and parallel to one another. Texturing is permanent when the deformed yarn, after such pulling and release, returns substantially to the crimped and bulked condition it was in before being pulled.

Descriptions of prior art processes for texturing of thermoplastic yarns by treatment with a stream of fluid stress the importance of treating the yarn with the fluid stream while the yarn tension is substantially zero. See, for instance, U.S. Pat. No. 3,380,242 to Richmond et al.

SUMMARY OF THE INVENTION

It has been found that thermoplastic yarn can be efficiently textured and, if the yarn is multi-filament, simultaneously entangled by passing the yarn into and through a yarn impingement zone and there impinging upon the yarn a converging stream of fluid as, for example, stream or heated air, which stream has previously been accelerated to a velocity above Mach 1. This fluid stream has an axial component of flow which is coaxial with the axis of the yarn as well as a radially inward component of flow. After the yarn is subjected to the impinging stream of fluid and while in a substantially tensionless state, it is cooled below its plasticizing temperature.

The process of the invention may be carried on in a jet nozzle of a configuration which provides for a fluid stream flowing with the moving yarn, which stream is converged to impinge upon the yarn in a yarn impingement zone. The configuration of the jet nozzle is such that the fluid stream is accelerated to a velocity in excess of Mach 1 and is then caused to impinge upon the yarn in the yarn impingement zone. Such acceleration is accomplished by providing a converging/diverging flow path for the fluid stream, i.e., a flow path in which the cross-sectional flow area is progressively changed without mathematical discontinuity by first reducing the area (as in a converging nozzle) and then increasing the area (as in a diverging nozzle) so as to pass through a minimum.

Benefits of the invention include high speed texturing below polymer melt temperature and a lower fluid mass flow rate at fluid pressures comparable to those of known texturing processes.

DESCRIPTIONS OF THE DRAWINGS

DETAILED DESCRIPTION

Figure 1:
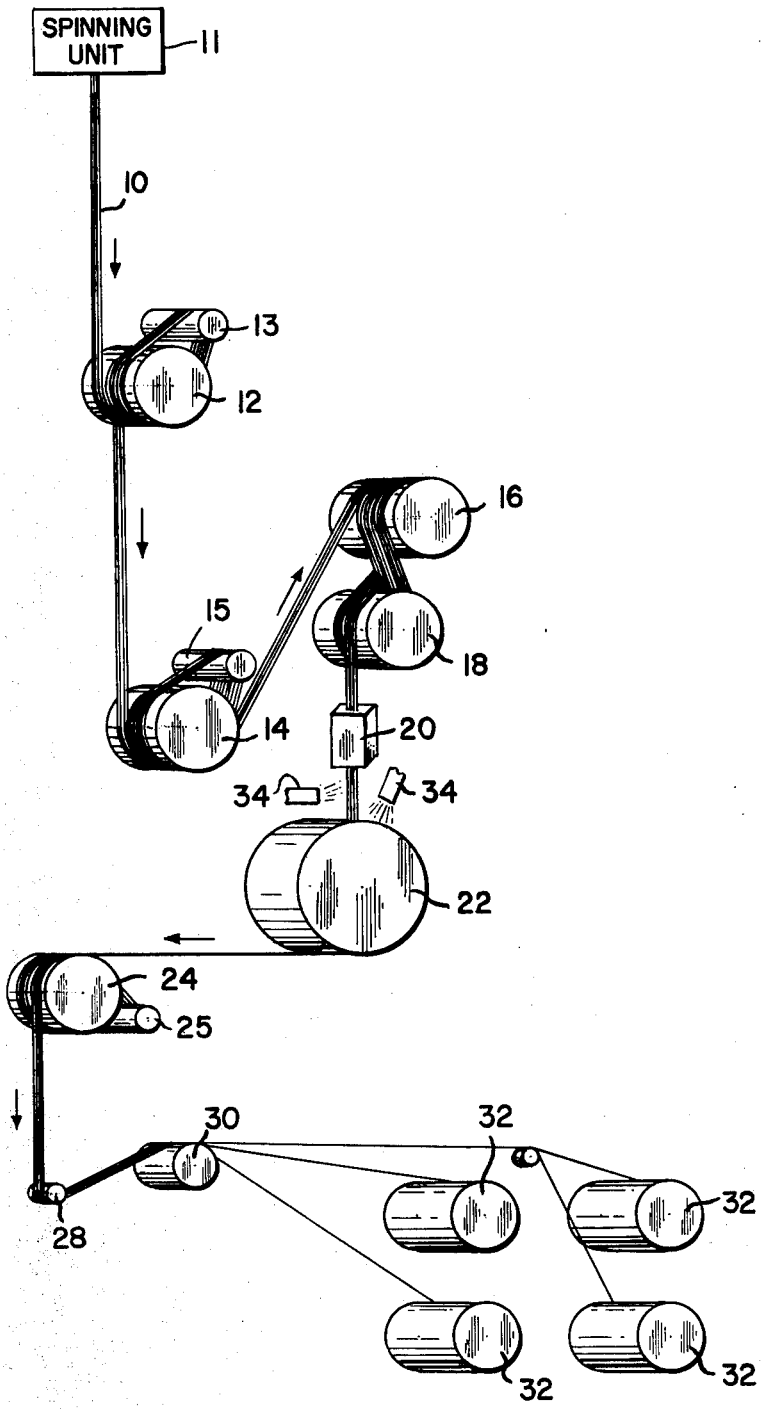
FIG. 1 is a schematic representation of a yarn draw texturing operation in which thermoplastic yarn is first drawn and then textured in accordance with this invention.

With reference to FIG. 1, four filaments of an undrawn thermoplastic yarn 10 are supplied from a package (not shown) or directly from a spinning unit 11 to a pretensioning godet roll 12 and idler roll 13, and are then passed over draw rolls 14 and 16. Roll 14 preferably is heated and has a slightly larger diameter than roll 12 to obtain the pretensioning. Idler rolls 13 and 15 assist in control of drawing. The relative circumferential speeds of the rolls are such as to provide the desired drawing ratio for the thermoplastic yarn being processed. In the case of nylon this ratio is about 3.5:1 to about 4:1. Roll 16 as well as another roll 18 are heated so that the yarn passing thereover is heated above its plasticizing temperature. Other forms of heating devices may be used for this purpose, if desired. After it is heated, the yarn is passed to the texturing jet 20 for impingement upon the yarn of an annular stream of a compressible fluid. The treatment of the yarn within this jet is discussed in greater detail below.

Whereas the yarn passing from the heating rolls through the jet 20 is under substantial tension, the yarn issuing from the jet 20 is under substantially zero tension. The yarn passing from the jet 20 in this substantially tensionless state is deposited on the periphery of transport drum 22. Before it reaches the surface of drum 22 or while reposing on the surface of the drum, the yarn cools below the plasticizing temperature. Drum 22 is hollow and has a screen on its circumference on which the yarn is held by suction through the screen so that the condition of the four filaments is equalized for subsequent processing and take-up. The rotation of the transport drum advances the yarn to a pre-determined position from which it is removed to godet roll 24 and idler 25, and thence over guide 28 and oil or finish application roll 30 to take-up rolls 32,. Fluid mist applicators 34 may be employed to spray-cool, quench or treat the yarn with various reagents as it passes to drum 22 and/or as it rests on the surface of the drum. Atmospheric cooling is also effective.

Figure 5:
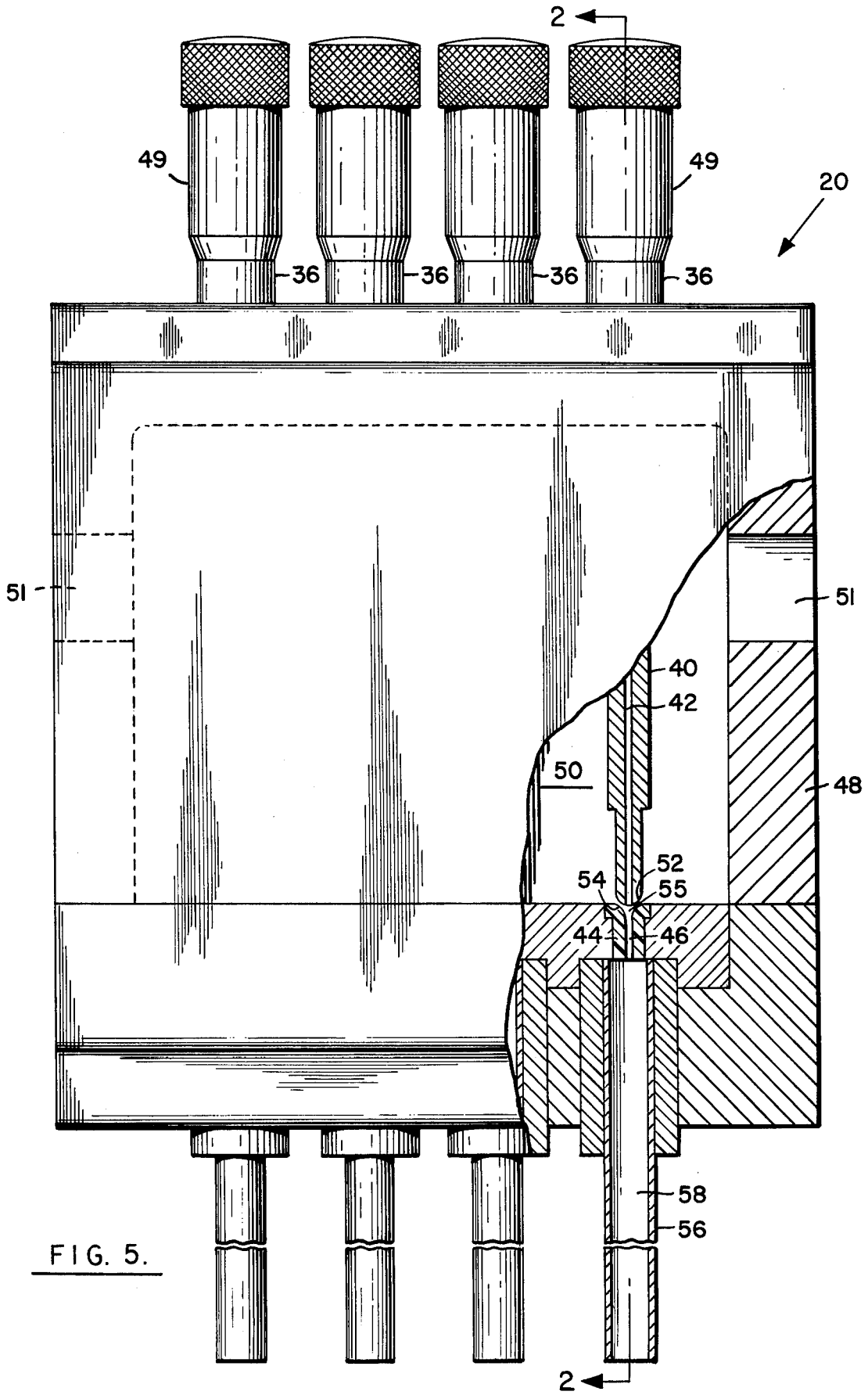
FIG. 5 is a frontal view of the jet of FIG. 2 with a portion broken away to show internal structure.
Figure 6:
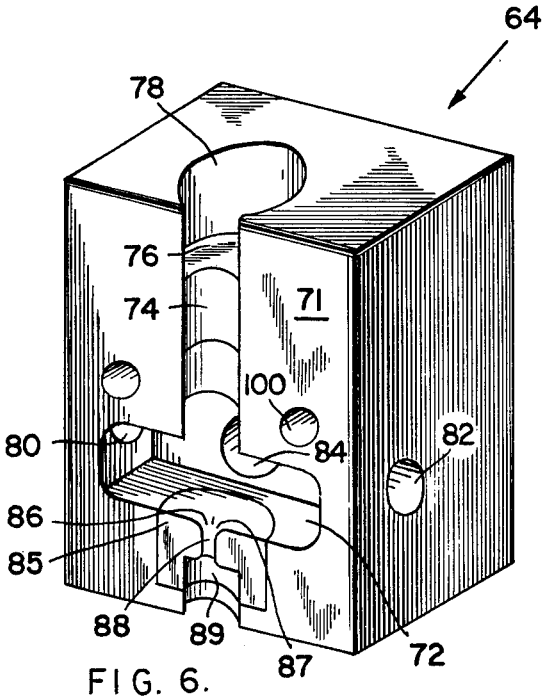
FIG. 6 is a perspective view of a portion of another embodiment of jet and jet nozzle of the invention.
Figure 7:
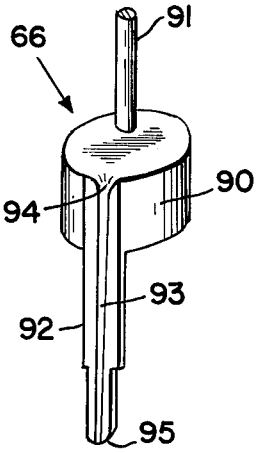
FIG. 7 is a perspective view of a needle element portion for use with the portion of jet shown in FIG. 6.

The structure and operation of one embodiment of fluid jet 20 may be appreciated by consideration of FIG. 5 which shows the four jet nozzles 36 of jet 20 for texturing of the four filaments shown in FIG. 1 as entering jet 20. A greater or lesser number of nozzles having a common enclosure or separate enclosures of course may be accommodated, depending on the number of filaments to be simultaneously textured.

Figure 2:
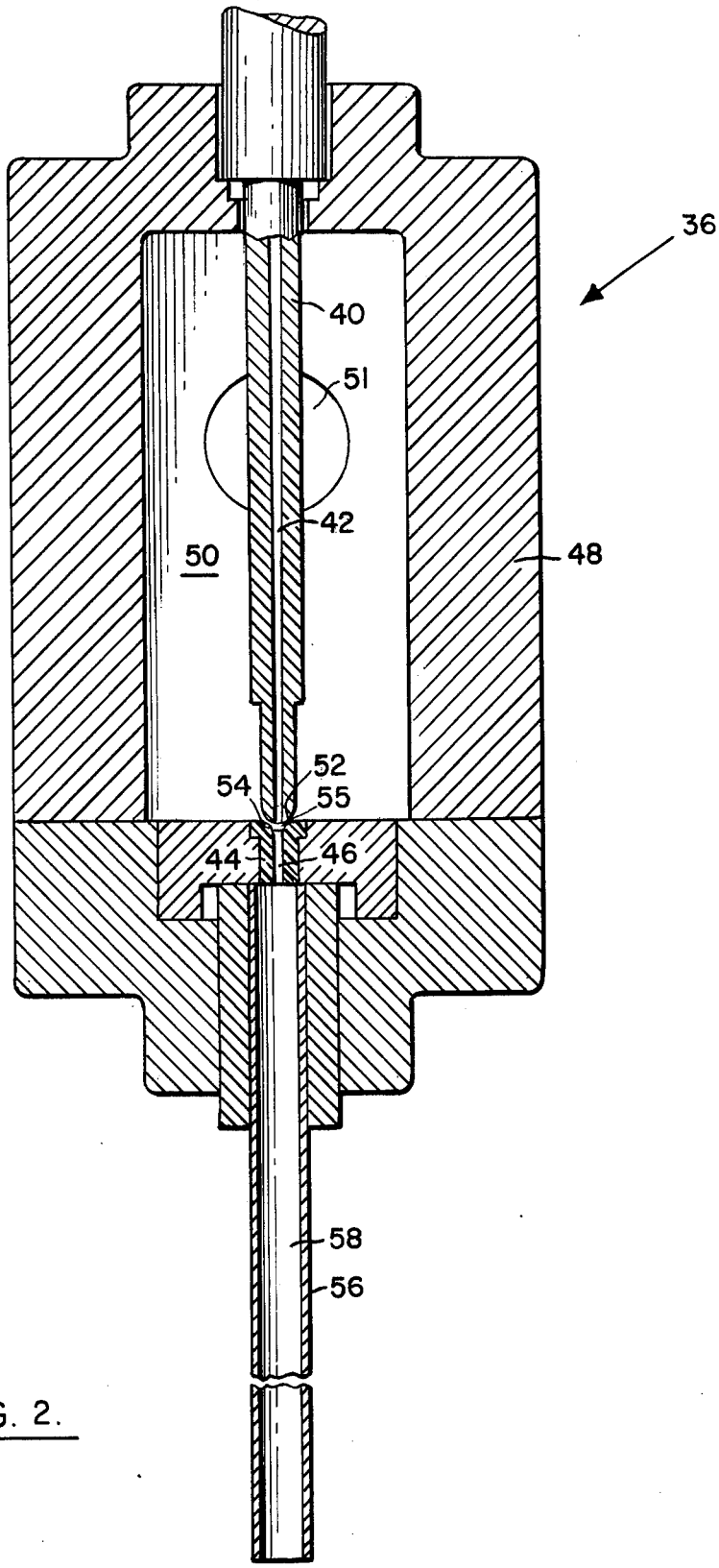
FIG. 2 is a cross-sectional view of one embodiment of a jet and jet nozzle of this invention, taken on the line 2—2 of FIG. 5.

More detail of the jet nozzles comprising the jet 20 is shown in the sectional view of FIG. 2. With reference thereto, a needle element 40 having a central axial yarn passage 42 therethrough is disposed along the axis of the jet nozzle 36. A throat element 44 having an axial yarn passage 46 is mounted downstream of yarn passage 42. As shown, yarn passages 46 and 42 are coaxially aligned. However, the alignment may also be eccentric, if desired. The throat element 44 may be formed of any wear-resistant material such as ceramic or metal. In this embodiment a jet nozzle body 48 defines an annular fluid chamber or passage 50 which surrounds the needle element 40. The geometry of the annular passage 50 is not critical since the pressure therein of the fluid admitted to the passage through an inlet port 51 is equal in all directions.

The exit surface 52 of the needle element 40 which is most closely adjacent the throat element 44 cooperates with the surface 54 of the throat element which is most closely adjacent the needle element to define an annular convergent/divergent passage. As further described below, the region of divergence defines a throat portion or yarn impingement zone 55.

The needle element 40 may be adjustably mounted in jet body 48 so as to permit its axial displacement with respect to the throat element 44. This is achievable by rotation of a micrometer head 49 which may displace needle element 40 by rotation with the micrometer. The passage 46 of the throat element communicates with an expansion tube 56 having a yarn passage 58 of substantially greater diameter than yarn passage 46.

The lower surface 52 of needle element 40 may have a spherical cross-section and the surface 54 of throat element 44 may have any convex conformation, as for instance that of a portion of a toroid. The relation of these two surfaces may best be seen in FIG. 3 wherein the surface 52 is shown to be spherical and the surface 54 is shown to be a portion of a torus. The two surfaces 52, 54 create an annular flow path which presents to the fluid flowing from the fluid flow chamber 50 to yarn passage 46 an annular cross-sectional frusto-conical flow area S, given by $S=\pi(r_1+r_2)g$ where $r_1$ and $r_2$ are radii and $g$ is the linear distance or gap between surfaces 52 and 54. In this formula $g$ is $\sqrt{h^2+(r_1-r_2)^2}$ where $h$ is the altitude of the conical frustum swept out by $g$. The flow area is at first progressively decreasing, as at $S_1$, $S_2$ and $S_3$, and thereafter progressively increasing, as at $S_4$ and $S_5$, thereby making it possible to accelerate the fluid flowing therethrough to a velocity in excess of Mach 1, i.e., to a supersonic velocity.

The annular flow area S is termed "cross-sectional", in that it is defined on the surface of a hypothetical conical frustum swept out by the linear distance $g$ across and around the gap between surfaces 52 and 54. It should be understood that the frusto-conical cross-section it hypothetical, that is, it refers to the flow area and does not necessarily require that the annular gap between surfaces 52 and 54 be symmetrical and in every case define a conical frustum, although symmetry is preferred and as illustrated in FIG. 1 and 2, the surfaces 52 and 54 do define a conical frustum therebetween. A primary aspect of the invention is the impingement upon an advancing yarn under tension of a fluid moving at supersonic velocity and flowing in an annular or semi-annular path. Generally, any two surfaces producing a continuous change in flow and a minimum flow during such continuous flow will provide such acceleration of the fluid. The invention therefore is not limited to an annular gap which defines a conical frustum but includes other geometries which provide the flow pattern described.

Figure 3:
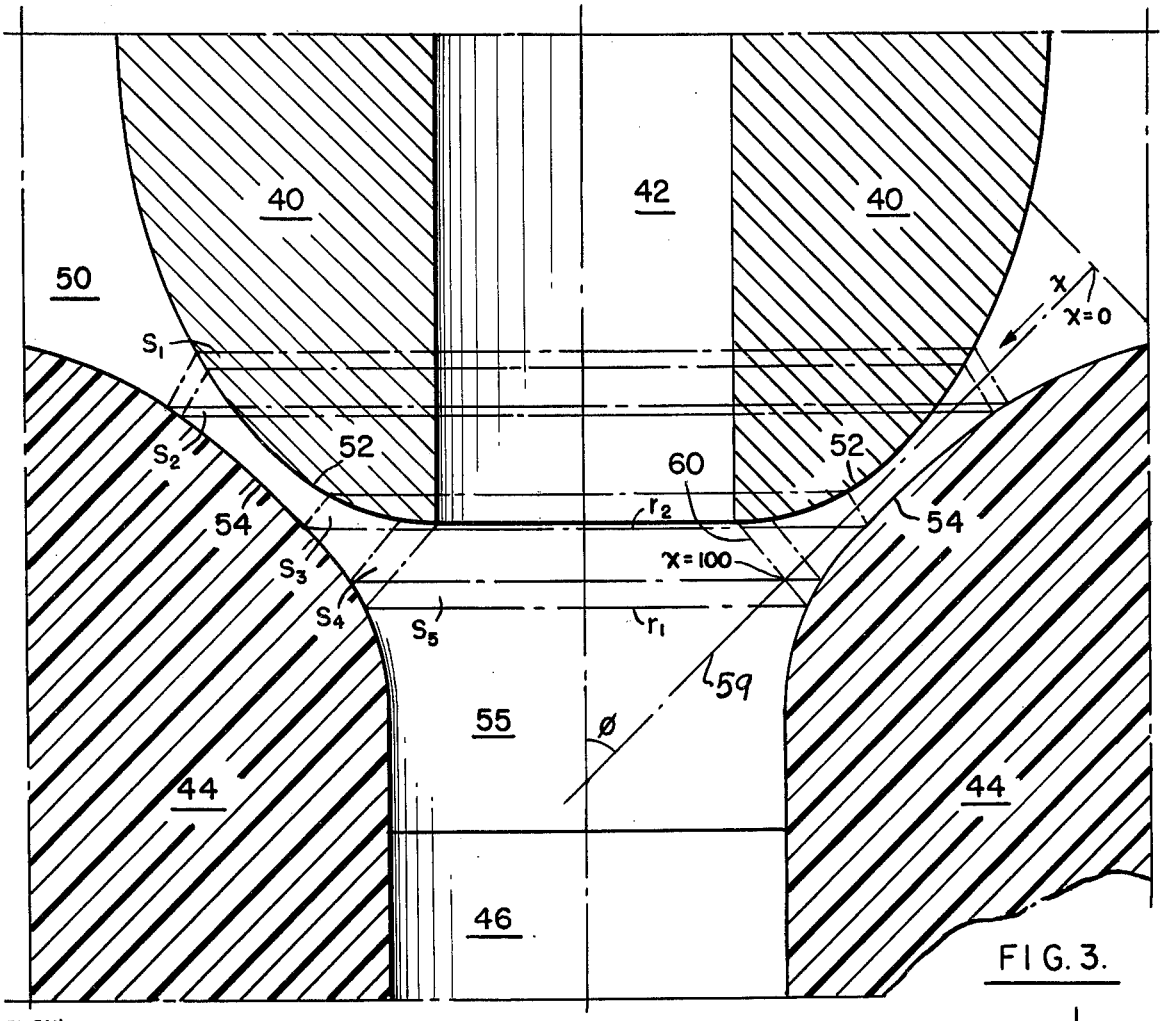
FIG. 3 is an enlarged portion of the cross-sectional representation of FIG. 2 showing the relationship of the adjacent surfaces of the jet nozzle which provide a convergent/devergent flow path for the stream of fluid.
Figure 4:
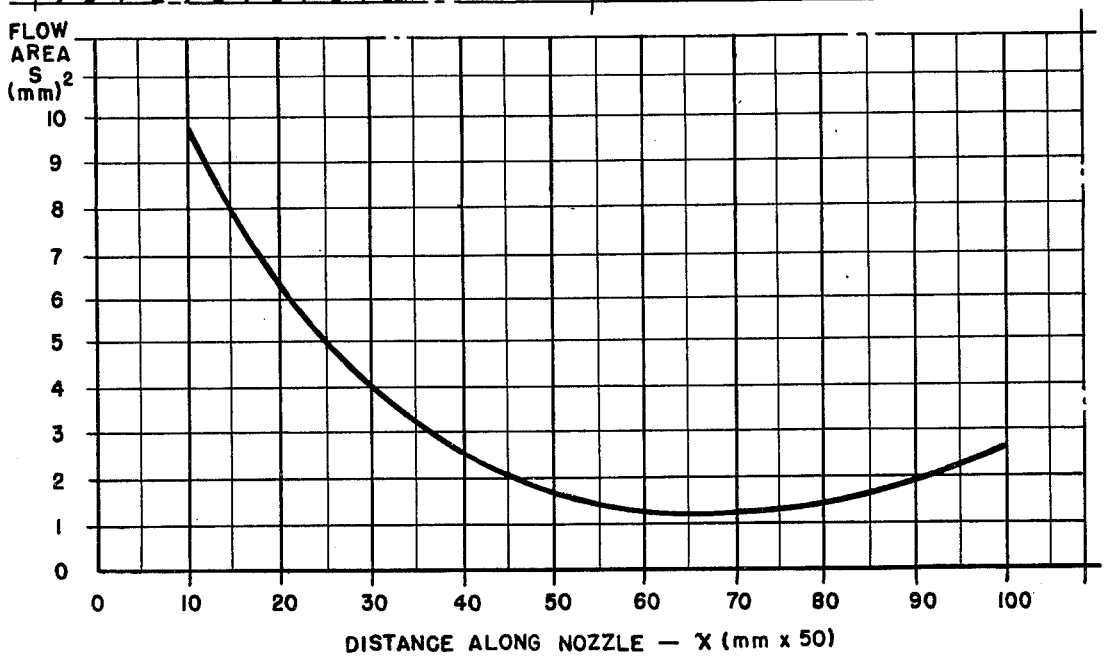
FIG. 4 is a plot of cross-sectional flow area S vs. linear distance x through a flow passage for the portion of the jet nozzle shown in FIG. 3.

FIG. 4 is a plot of the flow area S as a function of the distance $x$ along a line 59 through the converging/diverging conical passage of the particular configuration of nozzle shown in FIG. 3. The origin of $x$ ($x = 0$) is arbitrarily taken as a point 100 mm. along line 59 through the convergent/divergent flow passage, which line is intersected (at $x = 100$) at right angles by the line 60 (equivalent to distance g) connecting the terminus of the base radius $r_1$ of a conical frustum of area $S_5$ with the top radius $r_2$ thereof. For the particular geometry of FIG. 3, line 59 is a centrix and intersects the central axis of yarn passage 42 at an angle $\phi$ of about 45°. In this example the flow area S reaches a minimum $S_3$ at approximately 67 mm. on line 59 from the origin ($x = 0$) but this minimum flow area does not necessarily coincide with the point of minimum gap between surfaces 52 and 54. In other geometries such coincidence may exist. The annularly flowing fluid is accelerated in the flow passage and reaches sonic velocity at about this 67 mm. location and is further accelerated in excess of sonic velocity before it contacts the yarn. Thus the velocity of the fluid impinging upon the yarn in zone 55 is Mach 1 or greater. The axial component of this velocity exerts drag sufficient to produce tension on the yarn. The tensioning pulls the yarn through the needle so that it is positioned tautly in zone 55. Throughout the yarn impingement zone 55 the high velocity stream causes crimping. The radially inward component of this velocity causes entanglement of the yarn if the yarn is multifilament. The tautness of the yarn in zone 55 prevents the yarn from flying apart, if it is multi-filament, and generally serves to keep the yarn in the impingement zone.

It is not essential that the yarn drawing step be included in the same operation with the texturing step, as shown in FIG. 1, in order to achieve the benefits of the instant invention. Nor is it necessary to employ heated rolls of the type indicated in FIG. 1. What is required is that the yarn in the yarn impingement zone 55 be at a sufficiently high temperature, i.e., above its plasticizing temperature, so that the changes imposed upon it by the impinging fluid streams are maintained in the yarn during subsequent cooling and are permanently retained by the yarn. In order to assure sufficiently high yarn temperature in the yarn impingement zone, the use of a yarn preheater such as heated rolls 16 and 18 or other forms of contact or radiant heaters is desirable.

Upstream of the yarn impingement zone 55 the fluid flows in an annular path. Along the axis of this flow path the yarn is advanced in the direction of fluid flow. When employing the apparatus of the instant invention, the yarn is advanced through the yarn passage 42 of the axially placed needle element 40 as the fluid flows in the annulus surrounding the needle element. Regardless of the specific apparatus used, however, this arrangement provides for transfer of thermal energy from the fluid to the yarn in yarn passage 42 so that the yarn temperature is maintained or increased as the yarn advances to the yarn impingement zone. Such heat transfer is enhanced by maintaining a higher pressure, e.g., greater than atmospheric, at the exit tip of needle 40 than in passage 42.

As indicated, the impingement of the fluid stream upon the yarn has a dual effect. First, presumably due to the axial velocity component the yarn is under tension, thereby allowing feed and advancement axially to and through the yarn impingement zone at high speeds. The tensioning also maintains the yarn in a taut condition, thereby preventing the yarn from laterally escaping from the impingement zone. Secondly, presumably due primarily to the radial velocity component, the filaments of the yarn are crimped, usually with a high frequency of small amplitude crimps, so that the yarn is rendered more voluminous or bulky. If the yarn is multi-filament, entanglement also occurs.

The yarn and fluid continue axially downstream from the yarn impingement zone 55 through yarn passage 46 of throat element 44 with the yarn still under tension and above its plasticizing temperature. When the fluid reaches expansion tube 58, the sudden enlargement in cross-sectional flow area causes expansion of the fluid and reduction of axial velocity so that the yarn in the expansion tube becomes substantially free of tension. From the expansion tube the yarn advances to the surface of the transport drum 22 where it is also in a substantially tensionless state. Thus the yarn, after passing through the yarn impingement zone, is permitted to cool below its plasticizing temperature while under substantially zero tension so that the texture imparted to the yarn by the process will be permanent. That is to say, although sometimes there may be no apparent texture when the yarn is subsequently wound under tension into packages, the texture will re-appear if the yarn is thereafter removed from the package and viewed in a tensionless condition.

The fluid stream employed in the process of the instant invention may be any compressible fluid such as stream, hot or cold compressed air, or other gases, heated or unheated.

Figure 8:
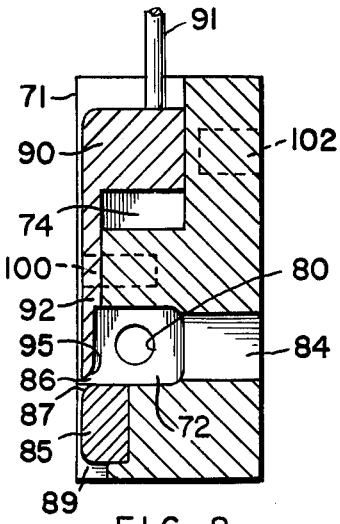
FIG. 8 is a vertical section of the composite of FIGS. 6 and 7, taken on the line 8—8 of FIG. 10.

FIGS. 6–10 illustrate another embodiment of a jet of the invention, in this case a single jet nozzle rather than a plurality of jet nozzles within single casing as in FIGS. 2 and 5. With reference to FIGS. 6–10 the jet nozzle includes a main body portion 64 in the form of a metal block machined to provide a suitable cutout for a needle element 66. A detachable face closure plate 68 and a needle element adjusting device such as a micrometer screw 70 are other elements of the jet nozzle. One face 71 of jet nozzle body portion 64 has an elongated, generally rectangular, fluid chamber 72 cut therein communicating with a vertical, semicylindrical lower channel 74 and an upper cavity defined by a horizontal surface 76 and a substantially cylindrical cavity 78 having a diameter greater than that of the lower channel 74. Chamber 72 is comparable in function to fluid chamber 50 of the jet nozzle embodiment of FIGS. 2 and 5 and has fluid inlet ports 80, 82 and 84 similar to inlet ports 51 of FIGS. 2 and 5. A removable throat elememt 85, similar in function to throat element 44 of FIGS. 2 and 5, is seated in a semi-cylindrical cutout adjoining fluid chamber 72. Throat element 85 has a half-round, frusto-conical, entry space 86 define by generally rounded surface 87. This entry space (as best seen in FIG. 8) defines a yarn impingement zone similar to zone 55 of FIGS. 2 and 5. A vertical, half-round channel running from the yarn impingement zone describes a yarn passage 88. Passage 88 opens into an expansion channel 89 similar in function to expansion tube 56 of FIG. 2.

Figure 10:
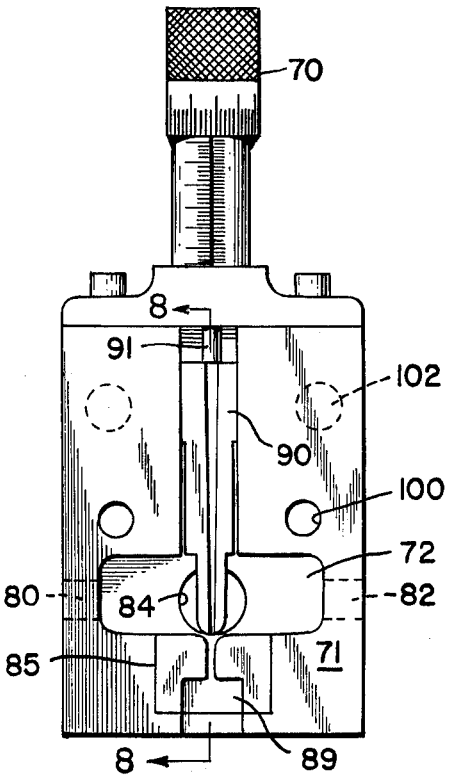
FIG. 10 is a frontal view of the device of FIG. 8.

Needle element 66 has a cylindrical upper portion 90, carrying a stationary pin 91, and a half-round lower portion 92, which portions are adapted to be slidably received in cavity 78 and channel 74, respectively, of nozzle body portion 64 as best seen in FIGS. 8 and 10. Extending along one side of needle element 66 and having a half-round cross-section is a slightly downwardly tapering yarn passage 93. The opening 94 of yarn passage 93 is frusto-conical upwardly to facilitate entry of yarn into passage 93. The lower tip of needle element 66 has a generally rounded surface 95 which, when is justaposition with the similarly generally rounded surface 87 of throat element 85 in a jet nozzle assembled with closure face plate 68, provides a convergent-divergent flow path to a fluid stream passing therebetween. The surfaces 87 and 95 therefore define a sonic nozzle equivalent to the sonic noozle defined by surfaces 52 and 54 of the jet nozzle of FIGS. 2 and 5 although without the full annularity of the nozzle of FIGS. 2 and 5. The relationship of these two surfaces 87 and 95 in defining a sonic nozzle is mathematically definable in essentially the same manner as described above with reference to FIG. 4 except, of course, for a flow area S in the jet nozzle of FIGS. 6–10 of about one-half that of the nozzle of FIGS. 2 and 5. In operation, therefore, a fluid stream passing between surfaces 87 and 95 is accelerated to a supersonic velocity and in zone 86 impinges upon yarn moving through yarn passage 93 and 88 so as to texturize the yarn essentially as described above with respect to the jet nozzle 36 of FIGS. 2 and 5.

Figure 11:
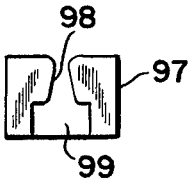
FIG. 11 is a frontal view of another embodiment of throat element for use with the devices of FIGS. 6–10.

FIG. 11 shows a modified form of throat element 97 which may be substituted for throat element 85. In throat element 97 the walls 98 of the yarn passage are funneled outwardly to more adequately accommodate passage of yarn which has been entangled as well as textured in accordance with the invention. The yarn then passes into an expansion channel 99.

Figure 9:
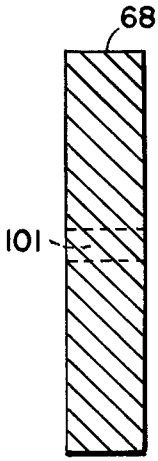
FIG. 9 is a vertical section of a face plate used with the portion of jet of FIG. 8.

The face plate 68 forms essentially a planar closure for the openings in face 71 of body 64 as well as for yarn passage 93 in needle element 66. The result is a split jet design and a semi-annular yarn impingement zone 86 or fluid flow path, as compared with the fully annular zone 55 or fluid flow path of FIGS. 2 and 5, with reference to the fluid stream in the vicinity of the tip surface 95 of needle element 66 and in the yarn impingement zone 86. However, the texturing afforded by this design is the same in essential respects as that afforded by the design of FIGS. 2 and 5. A similar, non-annular or semi-annular flow could be achieved, of course, by providing one or more vertical ribs along needle element 40 and/or along the interior walls of fluid chamber 50. Moreover, geometries of the yarn impingement zone 86 other than half-frusto- conical could provide the convergent-divergent fluid flow paths described. As best shown in FIGS. 8–10, face plate 68 may be affixed to nozzle body portion 66 by bolts (not shown) threadably received through holes 101 and 100. Similar holes 102 in face 71 may be used to mount the jet nozzle on a suitable frame.

The jet of this embodiment (FIGS. 6–10) has certain design advantages over that of the first embodiment. For example, the use of a face plate closure 68 permits easier access to the interior of the jet nozzle for cleaning and for the purpose of starting ("stringing up") a yarn through the yarn passages 93 and 88. In the design of FIGS. 2 and 5, the yarn must be threaded into the yarn passages 42 and 46 through an opening in the upper end of needle element 40. Furthermore, whereas the vertical location of needle element 40 of FIGS. 2 and 5 is adjusted by rotation of a micrometer such that needle element 40 also rotates, needle element 66 in FIGS. 6–10 is adjusted by rotating a micrometer without rotating the needle element. This is accomplished by the threading of micrometer 70 onto pin 91, thereby indirectly adjusting the position of needle element with respect to throat elements 85 or 97.

The invention is applicable to the treatment of thermoplastic filament yarns, i.e., yarns formed of thermoplastic polymers or those formed of other materials and modified to behave in thermoplastic fashion. While effective with monofilament yarns, the invention is particularly applicable to multi-filament thermoplastic yarns and especially such yarns in a denier and denier-per-filament range suitable for use as carpet pile yarn. Carpet pile yarns are frequently made by plying two or three ends of 1300 denier multi-filament, the filaments being in the 15 to 20 denier-per-filament range. Such 1300 denier multi-filament constructions are particularly suitable for use in the instant invention. Polyamides such as nylon 6 and nylon 66, polyesters such as poly(ethylene terephthalate), polyolefins such as polypropylene and acrylics such as polyacrylonitrile as well as certain cellulose acetates are examples of the thermoplastic materials used to form the thermoplastic yarns useful herein.

The following examples are intended as further illustration of the invention but are not necessarily limitative except as set forth in the claims. All parts and percentages are by weight unless otherwise indicated.

EXAMPLE 1–5

In apparatus substantially as shown in FIGS. 1 and 2 and under process conditions generally as described above, nylon 6 yarn (70 filament, 4700 nominal undrawn denier) was crimped and entangled. The jet nozzle (36) for each run had the following geometry: outside diameter of needle (40), 44.19 mm.; inside diameter of needle passage (42), 1.32 mm.; inside diameter of throat element (44), 1.7 mm.; throat element (44) toroid radius, 2.0 mm. Apparatus geometry and process conditions which were varied from run to run are indicated in Table I together with results of the runs. The data demonstrates efficient bulking (texturing and entanglement) of the yarn without adverse effects on other properties of the yarn.

TABLE I

| Example No. | 1 | 2 | 3 | 4 | 5 |
|---|---|---|---|---|---|
| Jet Nozzle (36) Parameters: | | | | | |
| Needle (40) tip radius, mm. | 2.096 | 45° conical frustum | 45° conical frustum | 45° conical frustum | 45° conical frustum |
| Vertical gap of needle (40) from contact with throat element (44), mm. | 0.18 | 0.28 | 0.28 | 0.28 | 0.29 |
| Process Conditions: | | | | | |
| Draw ratio | 3.6157/1 | 4.0/1 | 4.0/1 | 4.0/1 | 4.0/1 |
| Draw speed, m./min. | 590 | 285 | 600 | 900 | 960 |
| Jet fluid | air | steam | steam | steam | air |
| Jet nozzle temperature, ° C. | 191 | 187–194 | 187–194 | 187–194 | 190 |
| Jet nozzle pressure, psig | 100 | 105 | 105 | 105 | 106–109 |
| Take-up drum (32) speed, m./min. | 138 | — | — | — | — |
| Nip roll speed, m./min. | 452 | — | — | — | 850 |
| Overfeed (roll 18 to roll 24, Fig. 1), % | 31 | — | — | — | 13 |
| Drawing temperature, ° C. | 192 | 120 | 120 | 120 | 120 |
| Plasticizing temperature, ° C. | 192 | 160 | 160 | 160 | 160 |
| Air flow, SCFM (1) | 3.72 | — | — | — | 4.51 |
| RESULTS: | | | | | |
| Textured denier | 1488 | 1500 | 1398 | 1339 | 1295 |
| Tenacity - grams/denier | 3.43 | 3.78 | 4.32 | 4.63 | 4.84 |
| Elongation to break, % | 31.6 | 41.0 | 32.0 | 28.8 | 25.2 |
| Shrinkage, % | 19.0 | 14.4 | 14.4 | 14.0 | 11.5 |
| Entanglement, YETS(2) | 79 | 177 | 97 | 54 | 84 |
| Crimp Count(3) per inch | 8.2 | 6.7 | 6.3 | 6.2 | 5.6 |

(1)Standard cu. ft. per min.
(2)Yarn entanglements on test machine: No. of 10 g. stops per 2 meters
(3)Peak to peak counts per inch.

In view of the foregoing description it will be apparent that the invention is not limited to the specific details set forth therein for the purposes of illustration, and that various other modifications are equivalent for the stated and illustrated functions without departing from the spirit and scope of the invention.

I claim:

1. A jet nozzle for texturing thermoplastic yarn, comprising:

a fluid chamber;

a needle element positioned in said fluid chamber, said needle element having an axial yarn passage therethrough;

a throat element positioned downstream of said needle element, said throat element having an axial yarn passage aligned with the axial passage of said needle element;

The respective adjacent surfaces of said needle element and said throat element defining between them a flow passage communicating with said fluid chamber and converging toward said yarn passage of said throat element for flow of fluid therethrough to a yarn impingement zone;

said flow passage further characterized in that, on a succession of hypothetical frusto-conical sections taken along said flow passage in the direction of flow in such fashion that the surface of each of said sections is perpendicular to the direction of flow through said flow passage, the projections of the respective flow areas thereon become initially successively smaller and then successively larger so that the magnitudes of said successive areas pass through a minimum without undergoing any mathematical discontinuity, whereby a fluid passing through the flow passaage areas is accelerated to a velocity in excess of Mach 1 prior to impingement upon yarn in the yarn impingement zone and impinges upon the yarn in the yarn impingement zone at a velocity in excess of Mach 1 and at an angle causing texturing of the yarn.

2. The nozzle of claim 1 wherein the surface of said throat element adjacent said needle element is a segment of a toroid.

3. The nozzle of claim 1 wherein the surface of said throat element adjacent said needle element is a segment of a torus.

4. The nozzle of claim 1 wherein the surface of said throat element adjacent said needle element is frustoconical and the surface of the needle element adjacent to the throat element is convex.

5. The nozzle of claim 1 wherein the surface of said needle element adjacent said throat element is a segment of a sphere.

6. The nozzle of claim 1 wherein the surface of said needle element adjacent to said throat element is frustoconical and the surface of said throat element adjacent to said needle element is convex.

7. The nozzle of claim 1 wherein said needle element is axially adjustably mounted with respect to said throat element.

8. The nozzle of claim 1 wherein said flow passage is annular.

9. The nozzle of claim 1 wherein said flow passage is semi-annular.

10. The nozzle of claim 1 wherein said converging fluid flow passage is positioned such that, on a cross-sectional plane containing the central axis of said nozzle, the centrix of said flow passage forms an angle of approximately 45° with said central axis of said nozzle.

11. Apparatus for texturing thermoplastic yarn comprising the nozzle of claim 1 and further comprising an expansion tube communicating with the outlet of the yarn passage of said throat element.

12. The apparatus of claim 11 further comprising drum means rotably mounted such that the periphery thereof is adjacent the outlet of said expansion tube, said drum means having a perforated surface and suction means communicating with said drum means to exert suction inwardly through said perforated surface.

13. The apparatus of claim 11 further comprising means for advancing heat plasticized thermoplastic yarn to said yarn passage of the needle element of said nozzle, means for supplying heated, compressible fluid to said fluid chamber, and yarn wind-up means.

14. A jet nozzle assembly for simultaneously texturing a plurality of ends of thermoplastic yarn, comprising a fluid chamber, a plurality of needle elements positioned in said chamber, each of said needle elements having an axial yarn passage therethrough, a plurality of throat elements each coaxially aligned with one of said needle elements and downstream thereof, the respective adjacent surfaces of each set of needle and throat elements defining between them a flow passage having the characteristics of the flow passage defined in claim 1.

* * * * *